US005546780A

United States Patent [19]

Lee

[11] Patent Number: 5,546,780

[45] Date of Patent: Aug. 20, 1996

[54] METHOD AND APPARATUS FOR FORMING A LUBRICANT, CONDUCTING GROOVE IN A CYLINDRICAL SURFACE OF A BEARING MEMBER

[75] Inventor: Ho-Chul Lee, Seoul, Rep. of Korea

[73] Assignee: Samsung Electronics Co., Ltd., Suwon, Rep. of Korea

[21] Appl. No.: 330,787

[22] Filed: Oct. 28, 1994

[30] Foreign Application Priority Data

Oct. 28, 1993 [KR] Rep. of Korea ..... 93-22603

[51] Int. Cl.[6] ..... B21H 7/18

[52] U.S. Cl. ..... 72/75

[58] Field of Search ..... 72/75

[56] References Cited

U.S. PATENT DOCUMENTS 3,066,557 12/1962 Stevens ..... 72/75

FOREIGN PATENT DOCUMENTS 418963 3/1991 European Pat. Off. ..... 72/75

24748 10/1969 Japan ..... 72/75

*Primary Examiner*—Lowell A. Larson

*Attorney, Agent, or Firm*—Burns, Doane, Swecker & Mathis, L.L.P.

[57] ABSTRACT

A helical groove for conducting lubricant is formed in an internal cylindrical surface of a bearing member by pressing a plurality of balls against the surface while effecting relative longitudinal and rotational movement between the bearing member and a ball-carrier which carries the balls. The balls roll along the cylindrical surface and press-form the helical groove therein. To enable the ball carrier to be inserted into the bearing, the balls are held in a retracted state by applying a vacuum to the balls.

9 Claims, 3 Drawing Sheets

METHOD AND APPARATUS FOR FORMING A LUBRICANT, CONDUCTING GROOVE IN A CYLINDRICAL SURFACE OF A BEARING MEMBER

BACKGROUND OF THE INVENTION

1. Field of the Invention

The present invention relates to a manufacturing apparatus and method for rotating a bearing member capable of supporting a rotary shaft or sliding device and the like disposed in an electronic device or mechanical apparatus to thereby enable the same to rotate or slide, and more particularly to a bearing manufacturing apparatus and method by which a spiral lubricant groove for conducting lubricant along an inner periphery of the bearing member can be easily formed, so that the rotary shaft, sliding device or the like can smoothly rotate and slide therein.

2. Description of the Prior Art

Generally speaking, an electronic or the mechanical apparatus or the like is provided with a small rotary shaft or a sliding device, which can be driven by a small power and at the same time, is desirably arranged in a manner for minimizing the generation of noise or vibration.

Accordingly, a ball bearing, a Kind of rolling bearing generally used, has an advantage in that the same is adequate for a high-speed rotation and is capable of easily being lubricated. However the ball bearing has a disadvantage in that manufacturing cost is expensive due to necessity of using a plurality of balls and difficulty in processing a plurality of parts comprising inner/outer wheels (races) coupled to inner/outer sides of the balls, and a retainer and the like for maintaining spacial intervals of the balls.

Besides, the ball bearing has other disadvantages in that there easily occur noise and vibration therein and the same is vulnerable to shock and is not appropriate for ultra small sizes.

In view of these disadvantages, Japanese laid open patent application No. Sho 58-203222 discloses the making of a tubular bearing member by forming a lubricant groove in an inner periphery of which tubular bearing member as illustrated in FIG. 1, comprises: a sliding face 2 on an inner face of the bearing member 1; a pair of protruding units 3 on an outside surface thereof; and a helical lubricant groove 4 disposed in the sliding face 2 as a lubricant passage opposing the protruding units 3.

The bearing member is formed by pouring resin into a mold 7 comprising an inner form 5 and an outer form 6.

However, the prior art thus described has problems in that there are too many manufacturing steps complex structures calling for separate apparatuses for pouring and mixing of the resin, and abrasion-resistance, heat-resistance and, durability are remarkably deteriorated because of the bearings being formed of resin materials.

Accordingly, the present invention has been presented to solve the aforementioned problems for a the prior art, and it is an object of the present invention to provide a manufacturing apparatus of bearing by which productivity of the same can be improved by way of easy process operation for forming a fluid flowing groove to thereby enable the lubricant to flow in an inner face of the bearing, and at the same time, manufacturing cost can be markedly reduced.

SUMMARY OF THE INVENTION

The bearing manufacturing apparatus for forming a fluid underflow groove in an inner periphery of a bearing member wherein the lubricant can flow in the inner periphery according to the present invention comprises: a cylinder member having a plurality of holes carrying balls for forming a spiral fluid underflow groove in an inner periphery of a bearing member; a sliding shaft for being slid into a space formed of a the cylinder member, to thereby force out the balls against the inner periphery; and a vacuum pump for sucking out in the space to hold the balls in a retracted position until the bearing member and cylinder member are properly oriented.

Therefore, the bearing manufacturing apparatus according to the present invention enables the formation of a spiral fluid underflow groove by means of a simple structure by way of rolling motion of the balls pressing against in the inner periphery of the bearing member, to thereby improve productivity, and at the same time, to reduce manufacturing cost remarkably, and to improve abrasion-resistance, heat-resistance and durabilty because of a metallic material comprising the bearings.

BRIEF DESCRIPTION OF THE DRAWINGS

For a fuller understanding of the nature and objects of the invention, reference should be made to the following detailed description taken in conjunction with the accompanying drawins in which.

DETAILED DESCRIPTION OF A PREFERRED EMBODIMENT OF THE INVENTION

Figure 4:
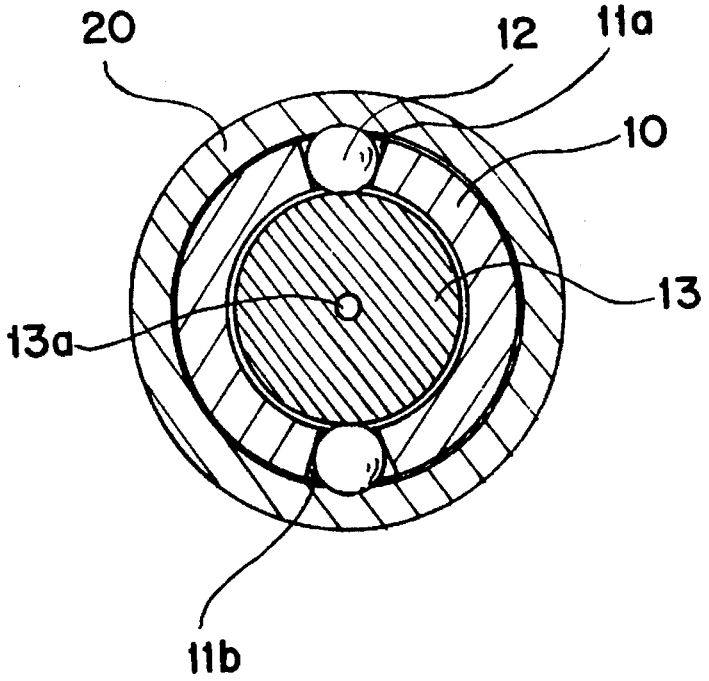
FIG. 4 is a cross-sectional view similar to FIG. 3 with the balls in an extended (operational) state.
Figure 5:
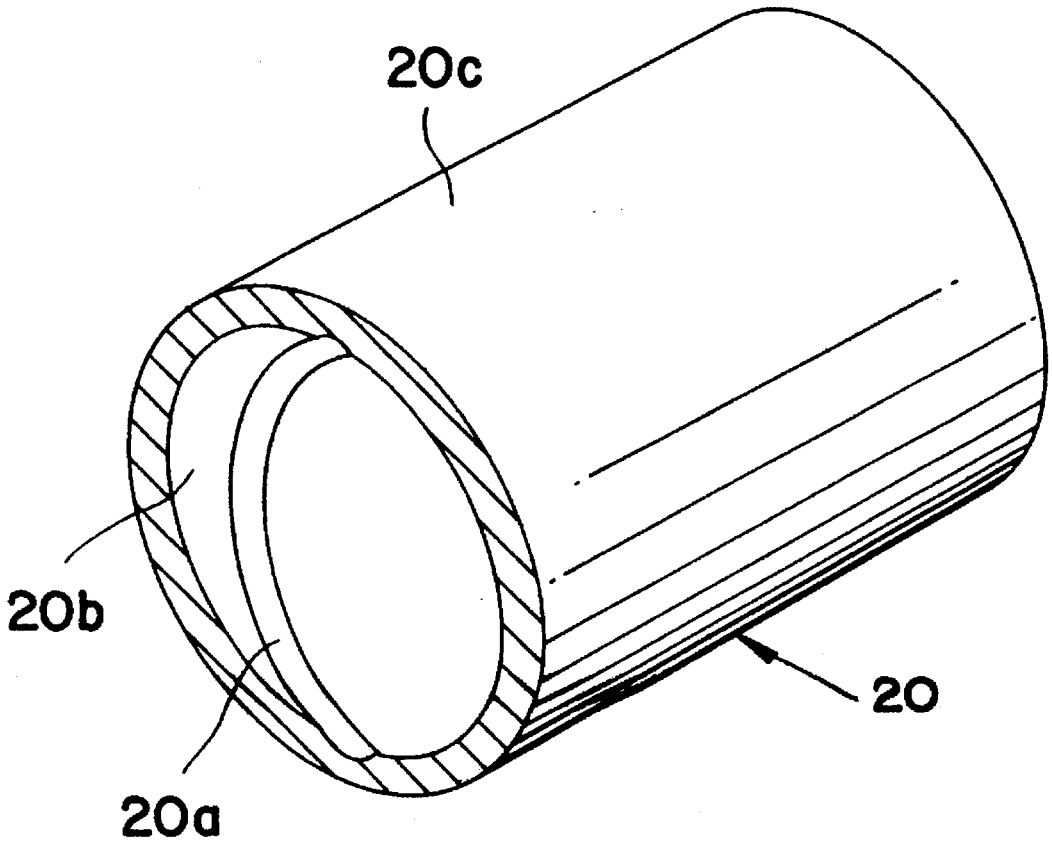
FIG. 5 is a perspective sectional view of a bearing manufactured according to the present invention.

Depicted in FIG. 5 is a tubular bearing member 20 formed by the method and apparatus of the present invention. The bearing member 20 comprises a helical groove **20*a* formed in an inner periphery 20*b* of a hollow cylindrical body 20*c*. The method and apparatus for forming the groove 20*a* in the body 20*c* will be described in detail with reference to accompanying FIGS. 2, 3, and 4**.

Figure 1:
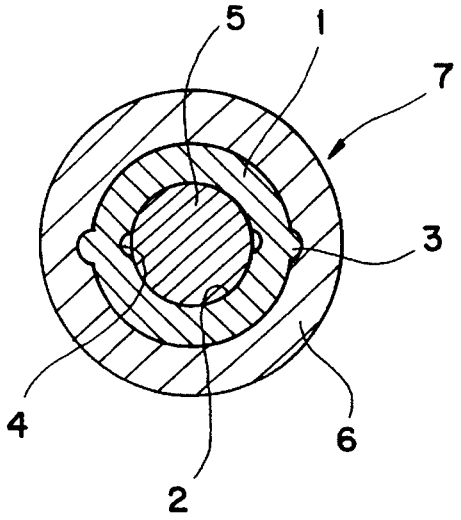
FIG. 1 (PRIOR ART)
FIG. 1 is a cross-sectional view through conventional mold for manufacturing a bearing.
Figure 2:
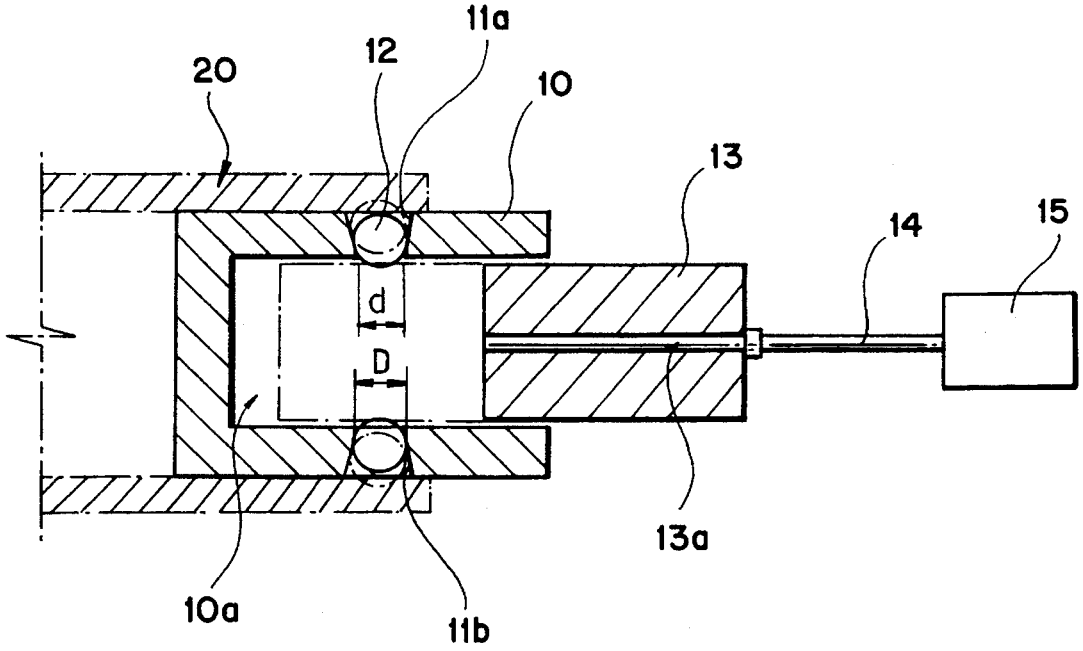
FIG. 2 is a longitudinal sectional view through a bearing manufacturing apparatus according to the present invention.

FIG. 2 is a sectional view for illustrating a bearing manufacturing apparatus according to the present invention, wherein reference numberal 10 denotes a cylinder member formed with a space **10*a*** within an inner side thereof and which is capable of being rotated and operated backward and forward by way of a separate means (not shown).

A pair of opposing piercing holes **11*a* and 11*b* are formed in the cylinder member 10, and the holes 11*a* and 11*b*** slantly taper off in diameters from the outside toward the radical inner side.

Furthermore, spheral indentation balls 12 are inserted in the piercing holes **11*a* and 11*b* for being pressed into the inner periphery 20*b* of the bearing body 20*b* which is slid over the outside of the holes 11*a* and 11*b* to thereby form the helical fluid underflow groove 20*a***.

It should be noted that the bearing member 20 is advisably formed from a metallic material of brass and the like. By way of example, it should be further advised that the bearing member 20 be formed with a delta metal deoxidized by phosphorus (P), manganese (Mn) and the like and added by iron (Fe) of 1% to brass (Cu6:Zn4).

Diameter D of the indentation ball 12 is preferred to be larger than a minimal diameter d of the holes 11*a* and 11*b* in order to prevent the ball 12 from entering the space 10*a*, and it is further preferred that part of the indentation ball 12 be protruded radially inwardly from the holes 11*a* and 11*b* by a distance the same as the depth of the fluid underflow groove 20*a* to be formed.

Meanwhile, a slide shaft 13 having a central air passage 13*a* is slidable and insertedly disposed at the space 10*a* formed within the cylinder member 10.

A connecting pipe 14 is connected at one end thereof to a tip of the air passage 13*a*, and the other end of the connecting pipe 14 is mounted to vacuum pump 15 for sucking the air from within the space 10*a* to thereby maintain the space 10*a* under a vacuum.

It should be advised that the connecting pipe 14 be connected in such a manner as to be adequately rotated according to rotary operation of the cylinder member 10 and the slide shaft 13.

Next, the operation of the bearing manufacturing apparatus according to the present invention will be described.

First of all, the vacuum pump 15 is operated while the indentation balls 12 formed within the holes 11*a* and 11*b* whereby the air within the space 10*a* is sucked through the air passage 13*a* and the connecting pipe 14. Then a predetermined vacuum pressure is maintained within the space 10*a*, to thereby draw the balls 12 in the holes 11*a* and 11*b* to radially inwardly, so that part of each of the balls 12 protrudes into the space 10*a*.

At this time, the balls 12 do not project radially outwardly of the holes, which makes it easy for the bearing member 20 to be inserted over the outside of the cylinder member 10.

Figure 3:
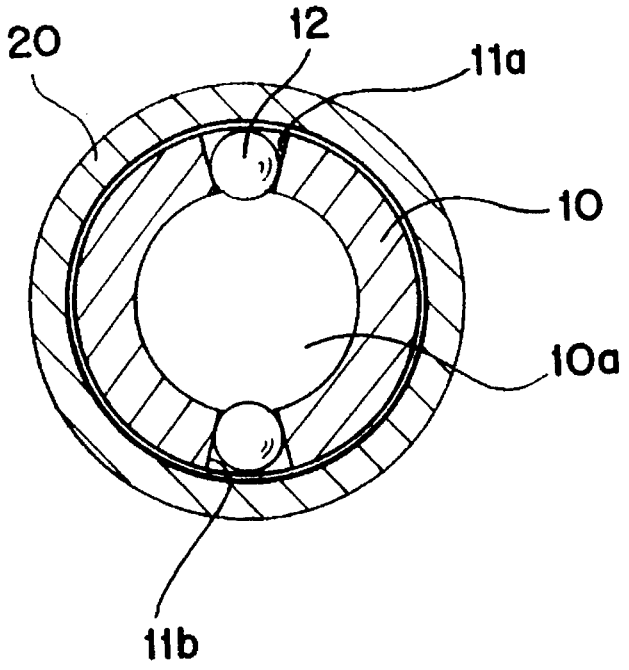
FIG. 3 is a cross-sectional view through the bearing manufacturing apparatus of FIG. 2 with the balls thereof in a retracted (non-operational) state.

When the slide shaft 13 is then inserted into the space 10*a* of the cylinder member 10 while the bearing member 20 is disposed over the outside of the cylinder member 10 as illustrated in FIG. 3, the periphery of the slide shaft 13 pushes the balls 12 radially outwardly as illustrated in FIG. 4. The balls 12 pushed to the outside of the holes 11*a* and 11*b* by the pressure from the slide shaft 13 are pressed to a predetermined depth into the inner periphery 20*b* of the bearing member 20 mounted on the outside of the cylinder member 10.

Furthermore, when the cylinder member 10 and the slide shaft 13 are then rotated at a slow speed and simultaneously operated forwardly while the bearing member 20 is fixed, a bearing having a helical fluid underflow groove 20*a* of a predetermined pitch can be obtained as illustrated in FIG. 5.

At this time, when each ball 12 is pressed into to the inner periphery of the bearing member 20, to thereby form the helical fluid underflow groove 20*a*, a rolling motion of the ball is realized to thereby minimize the abrasion of the ball 12 and heat generated by friction as well.

In case the ball 12 is to be replaced by reason of abrasion and the like, the operation of the vacuum pump 15 is stopped to release the vacuum in the space 10*a*, thereby enabling removal of the balls 12, within the holes 11*a* and 11*b*.

In the present embodiment, the bearing member 20 is fixed while the cylinder member 10 and the sliding shaft 13 are rotated and operated forward and backward. Conversely, it should be apparent that the cylinder member 10 and the sliding shaft 13 can be fixed whild the bearing member 20 can be rotated, and operated forward and backward, to thereby form a fluid underflow groove 20*a* in the inner periphery of the bearing member 20.

As seen from the foregoing, according to the bearing manufacturing apparatus of the present invention, a spiral fluid undercurrent groove can be formed by the rolling motion of the indentation balls on the inner periphery of the bearing member in a simple structure, thereby improving productivity and at the same time, reducing markedly the manufacturing cost. Furthermore, because the bearing is made of metallic materials, there are advantages in that the abrasion-resistance, heat-resistance, durability and the like can be improved.

Having described a specific preferred embodiment of the invention with reference to the accompanying drawings, it is to be understood that the invention is not limited to those precise embodiment, and that various changes and modifications may be effected therein by one skilled in the art without departing from the scope or spirit of the invention as defined in the appended claims.

What is claimed is:

1. Apparatus for forming a lubricant-conducting groove in an internal cylindrical face of a bearing member, comprising:

a hollow ball carrier having a cylindrical outer surface and at least one hole extending radially from said outer surface to an inner surface of said carrier, a ball freely rotatably mounted in said at least one hole, said at least one hole being tapered from a largest cross-section thereof at said outer surface to a smallest cross-section at said inner surface, said smallest cross-section being small enough to prevent travel of said ball completely therethrough and large enough to enable an inner portion of said ball to project therethrough and into an interior space of said carrier defined by said inner surface, said ball being radially movable relative to said carrier with reference to a longitudinal axis thereof, said carrier being positionable relative to said bearing member such that said at least one ball is in opposing relationship to the cylindrical face of the bearing member;

said ball carrier and cylindrical face being relatively movable longitudinally along said axis and rotationally about said axis; and a pusher member sized to enter said interior space for engaging said inner portion of said ball and pushing said ball radially outwardly against the cylindrical face so that said ball rolls along the cylindrical face to form a helical groove therein during said relative longitudinal and rotational movements.

2. The apparatus according to claim 1, further including a vacuum source for applying a vacuum within said interior space to draw said ball radially inwardly.

3. The apparatus according to claim 2 wherein said pusher member includes a passage for communicating said interior space with said vacuum source.

4. The apparatus according to claim 2 wherein said ball is sized so that no portion of said ball projects through said largest cross-section when said vacuum is being applied, to permit said ball to enter said bearing member prior to being engaged by the pusher member.

5. The apparatus according to claim 1 wherein said ball carrier includes a plurality of said holes each receiving a said ball.

6. A method of forming a lubricant-conducting groove in an internal cylindrical face of a bearing member, comprising the steps of:

A. providing at least one freely rotatable ball in a tapered hole of a hollow ball carrier, a largest cross-section of said hole disposed in an outer surface of said carrier, and a smallest cross-section of said hole disposed in an inner surface of said carrier, said smallest cross-section being small enough to prevent said at least one ball from passing completely therethrough and large enough so that an inner portion of said at least one ball can project into an interior space defined by said inner surface;

B. applying a vacuum within said interior space so that said inner portion of said at least one ball projects into said inner space, and no portion of said at least one ball projects outwardly through said largest cross-section;

C. inserting said carrier into said bearing member;

D. positioning a pusher member within said interior space and into contact with said inner portion of said at least one ball to push said at least one ball radially outwardly into contact with said internal face of said bearing member; and E. producing relative longitudinal and rotational movements between said internal face and said ball carrier while urging said at least one ball against said internal face such that said at least one ball rolls along and presses into said internal face to form a helical groove therein.

7. The method according to claim 6 wherein step B comprises applying said vacuum through a passage formed in said pusher member prior to step D.

8. The method according to claim 6 wherein step E comprises moving said bearing member longitudinally and rotationally while holding said ball carrier stationary.

9. The method according to claim 6 wherein step E comprises moving said ball carrier longitudinally and rotationally while holding said bearing member stationary.

* * * * *